United States Patent [19]

Loup et al.

[11] 4,194,173

[45] Mar. 18, 1980

[54] SOLENOID CONSTRUCTION

[75] Inventors: Ronald L. Loup, Clarkston; Arthur W. Gill, Saline, both of Mich.

[73] Assignee: Double A Products Company, Manchester, Mich.

[21] Appl. No.: 933,177

[22] Filed: Aug. 14, 1978

[51] Int. Cl.[2] ..... H01F 7/08

[52] U.S. Cl. ..... 335/260; 335/262

[58] Field of Search ..... 335/251, 255, 260, 261, 335/262

[56] References Cited

U.S. PATENT DOCUMENTS

| | | | |
|---|---|---|---|
| 3,082,359 | 3/1963 | Mangiafico et al. | 335/260 X |
| 4,004,343 | 1/1977 | Marsden | 335/262 X |
| 4,025,887 | 5/1977 | Romans | 335/251 X |
| 4,054,854 | 10/1977 | Marsden | 335/260 |

*Primary Examiner*—George Harris

*Attorney, Agent, or Firm*—Olsen and Stephenson

[57] ABSTRACT

A wet plunger type solenoid primarily for use with hydraulic valves adapted for high pressure hydraulic fluid systems, the armature assembly being constructed so that a stainless steel armature tube can be employed to provide a strong plunger chamber that will withstand high pressures of the hydraulic fluid, and the armature tube and the associated yoke and stop pieces at the ends of the plunger chamber are arranged so that the non-magnetic tube does not cause an "air gap" in the magnetic fluid of the solenoid, thereby allowing the solenoid to operate at lower electrical loads and temperatures.

4 Claims, 4 Drawing Figures

SOLENOID CONSTRUCTION

BACKGROUND OF THE INVENTION

The present invention relates to solenoids of the wet plunger type wherein the plunger is in a chamber that is open to the hydraulic fluid in the valve to which the solenoid is operatively connected.

It is conventional practice to actuate hydraulic valves by the use of dry solenoids wherein the push pin of the solenoid passes through a seal into the interior of the valve for moving one of the valve components, such as a spool. The electrical power requirements of these solenoids are relatively low, but the dry solenoids are unsatisfactory for use in many installations, because of problems that arise with respect to the seals. The seals have limited capacity, such as 1000 psi., for example, thereby limiting the capacity of the complete valve assembly to installations wherein the hydraulic pressures will not exceed the pressure capacity of the seals. Still further, the seals may develop leaks because of wear, shortening the life of the complete valve assembly.

To overcome these inadequacies of the dry solenoids, wet plunger solenoids have been developed wherein seals are omitted, and the plunger is movable in a chamber that is in direct communication with the hydraulic fluid within the valve. The chamber is formed by an armature tube and stop or pole pieces that are secured to the ends of the tube, and the high pressure hydraulic fluid can enter the chamber via the duct that extends through the one stop, nearest to the valve, and in which the armature push pin is positioned. The plunger can move in the chamber in response to the magnetic field produced when the solenoid is energized. Thus, the limitations placed on the valve by the seal are avoided, but additional problems are created.

Initially, the known wet plunger solenoids are faced with construction problems, because the plunger chamber must be sufficiently strong and leak-proof to withstand relatively high pressures, such as 3000 psi., for example. This condition makes it difficult to connect the armature tube to the stop pieces that form ends of the plunger chamber. Metal, such as stainless steel, is very desirable for manufacturing the tube, because of its non-magnetic properties and strength. The non-magnetic properties provide maximum possible hindrance to passage of the magnetic field axially through the midportion of the tube. Passage of a portion of the magnetic field through the tube would be an undesirable condition to exist, because the available field tending to move the plunger to actuate the valve would be lessened. However, in the prior art units the non-magnetic properties are harmful in other respects, because the tube, at its extremities passes through the magnetic field, providing an undesirable "air gap". To overcome this "air gap" problem, the prior art units require greater electric current to be passed through the coil, thereby causing overheating problems. Thus, the prior art units have been compelled to make the wall of the tube as thin as possible for the purpose of minimizing the thickness of the "air gap". Consequently, because of the thin nature of the tube, considerable difficulty exists in joining the tube to the stop pieces, this joining operation now normally being carried out by welding or brazing the parts together.

Efforts have been made to overcome the foregoing problems associated with wet plunger solenoids. One such effort is disclosed in U.S. Pat. No. 3,633,139, patented Jan. 4, 1972, in the name of Richard Thompson. The solution proposed in this patent is to heat treat the tube so as to establish a nonmagnetic band through the midportion of the tube and so as to establish magnetic properties in the end portions of the tube. This solution is explained in detail in the cited reference and will not be discussed further here, except to observe that the solution fails to solve fully the "air gap" problem, and further, it increases the difficulty of manufacturing the solenoid.

Thus, there still remains a need for an improved wet plunger solenoid that is capable of use with high pressure hydraulic valves and which will operate at relatively low electrical power to minimize power usage and avoid overheating problems.

SUMMARY OF THE INVENTION

The present invention has overcome the inadequacies of the prior art that are discussed above. According to a preferred form of the present invention, a wet plunger solenoid is provided that has an armature assembly including front and rear magnetic stop pieces, a nonmagentic tube connected at opposite ends respectively to the front and rear magnetic stop pieces and defining therebetween a chamber, the front stop piece having a duct extending axially therethrough, a pin positioned in the duct for axial movement and extending exteriorly of the front stop piece, and a plunger mounted within the chamber for reciprocal axial movement between the stop pieces and responsive to a magnetic field to exert a biasing action on the pin. A casing surrounds the circumference of the armature assembly and includes a coil and an associated yoke arranged to induce a magnetic field through the plunger when current is passed through the coil. The yoke has its opposite ends in engagement respectively with the front and rear stop pieces so that the working gap between the plunger and the stop pieces is the only air gap in the induced magnetic field. The tube has an axial length sufficiently small so that the front and rear stop pieces are connected to the tube between the locations where engagement of the front and rear stop pieces with the yoke occurs, thereby to eliminate an air gap between the yoke and either stop piece. By virtue of this construction the entire tube can be made of stainless steel, and the tube can be connected to the stop pieces by threaded connections. This is a distinct advantage over the prior art units because the electrical load that must be applied to the solenoid to generate the desired forces in the magnet are minimized, resulting in a more economical solenoid and also minimizing heat problems. Still further, the threaded connections allow the armature assembly to be diassembled for servicing purposes, as well as simplifying the initial assembly of the parts.

In the preferred construction, the rear stop piece is cup-shaped with the open end thereof facing the front stop piece, and the plunger is slidably movable in an axial direction in the rear stop piece and has an enlarged head portion for seating on the lip of the cup-shaped stop piece when the plunger is moved to its engaged position therewith. This construction and arrangement assures optimum positioning of the plunger in the magnetic field.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figures 1, 2, 3, 4:
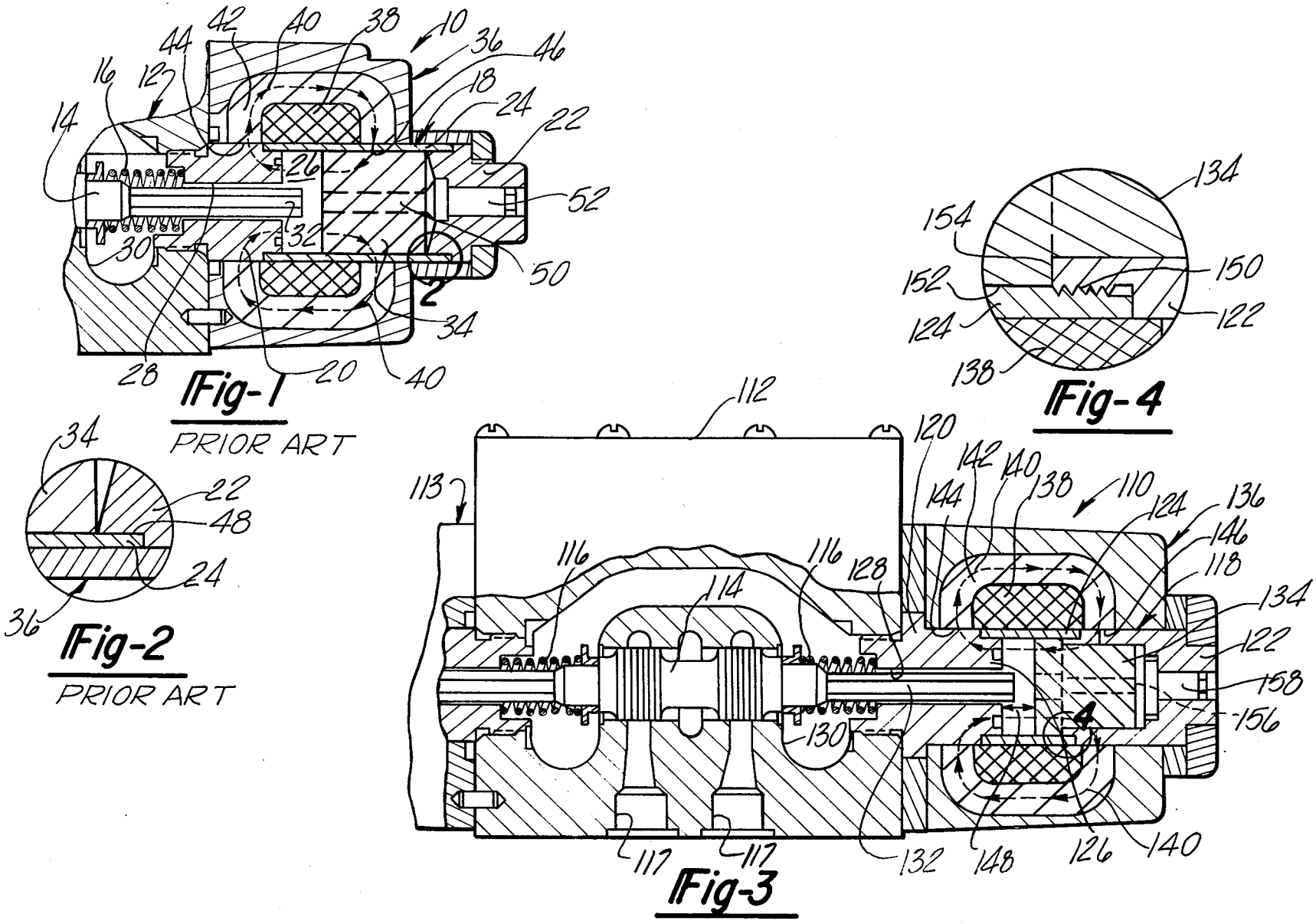
Fig-1 PRIOR ART
Fig-2 PRIOR ART
FIG. 1 is a fragmentary cross section of a wet plunger solenoid of the type known in the prior art.
FIG. 2 is a fragmentary enlarged section of a portion of FIG. 1.
FIG. 3 is a fragmentary cross section showing a portion of a conventional hydraulic directional valve on which is mounted a wet plunger solenoid embodying the present invention.
FIG. 4 is an enlarged fragmentary section illustrating a portion of FIG. 3.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawing, the prior art form of the invention, illustrated in FIGS. 1 and 2, will first be described, after which the preferred embodiment of the invention shown in FIGS. 3 and 4 will be explained in greater detail. The conventional wet plunger solenoid 10 is mounted on a conventional hydraulic directional valve 12 which includes the spool 14 and positioning spring 16. The wet plunger solenoid 10 has an armature assembly 18 which includes the front stop piece or pole piece 20 and the rear stop piece or pole piece 22, and an armature tube 24 connected at its opposite ends respectively to the front and rear stop pieces 20 and 22 to define therebetween a plunger chamber 26. The front stop piece 20 has a duct 28 extending axially therethough in communication with the chamber 26. The forward end of the duct 28 is in communication with the passageway 30. The latter contains hydraulic fluid that flows through the valve 12. A pin 32 is positioned in the duct 28 for axial movement and extends exteriorly of the front stop piece 20 for engaging the end of the spool 14. The pin can be hexagonal shape in cross section or have flat surfaces so as to permit free flow of the hydraulic fluid between the passageway 30 and the chamber 26. A plunger 34 is mounted within the chamber 26 for reciprocal axial movement between the stop pieces 20 and 22 and is responsive to a magnetic field to exert a biasing action on the pin 32 in the direction of the spool 14.

A casing 36 surrounds the circumference of the armature assembly 18 and includes an electrical coil 38 and an associated yoke 40 which are arranged to induce a magnetic field with lines of flux as indicated at 42 through plunger 34 when current is passed through the coil 38. The yoke 40 has its forward end 44 in close proximity to the front stop piece 20 and its rear end 46 in close proximity to the outer surface of the tube 24. Thus, the lines of flux of the magnetic field must pass radially through the wall of the tube 24.

To facilitate free flow of hydraulic fluid past the plunger 34 when the latter moves, a flat side 50 is formed in the plunger 34. Also, a manual override push pin 52 of conventional construction is also provided in stop piece 22.

As indicated above, the construction and arrangement shown in FIG. 1 wherein the lines of flux 42 of the magnetic field must pass radially through the tube 24 creates considerable problems in connection with this type of wet plunger solenoid. It is desirable that the tube 24 be made of material having considerable strength and also of material that will not act as a hindrance to the magnetic field trying to pass through the tube 24 in a radial direction. It is also necessary that the tube 24 have non-magnetic properties through at least a portion of its length to act as a hindrance to the lines of flux passing axially through the plunger 34 to create the maximum magnetic forces.

To overcome the defects pointed out above, efforts have been made to heat treat the tube 24 to provide both magnetic and non-magnetic properties therein, as is particularly described in the aforesaid U.S. Pat. No. 3,633,139. Other efforts have been made to accomplish this purpose by welding tubular segments of magnetic and non-magnetic properties together. All of these efforts have created difficult problems to overcome. Also, they still make it necessary for the wall of the tube 24 to be as thin as possible, and this has further made it necessary to join the tube 24 to the front and rear stop pieces 20 and 22 by welded or brazed joints 48 (FIG. 2). This construction makes it difficult to repair units of this type in addition to creation of initial construction problems.

Referring now to FIGS. 3 and 4, the preferred form of the present invention will be described. As is there shown, the wet plunger solenoid 110 is mounted on the hydraulic directional valve 112 and a similar wet plunger solenoid 113 is mounted on the other end of the hydraulic directional valve 112, but it will not be described in detail, because it is constructed essentially the same as the solenoid 110. The conventional hydraulic directional valve 112 includes the spool 114 and positioning springs 116. Movement of the spool 14 by the solenoids 110 and 113 serves to provide communication between different inlet and outlet ports, such as shown, for example, at 117. The wet plunger solenoid 110 includes an armature assembly 118 which has a front stop piece 120 and a rear stop piece 122 of magnetic material, and a non-magnetic tube 124 that is connected at its opposite ends respectively to the front and rear stop pieces 120 and 122. These three pieces define between them a plunger chamber 126. The front stop piece 120 has a duct 128 extending axially therethrough in communication with the chamber 126 and in communication with the passageway 130 of the valve 112 so that hydraulic fluid can flow between the chamber 126 and the passageway 130. A pin 132 is positioned in the duct 128 for axial movement and extends exteriorly of the front stop piece 120 for engagement with the end of the spool 114. The pin 132 has a hexagonal shape in cross section to permit free flow of the hydraulic fluid through the duct 128.

A plunger 134 of magnetic material is mounted within the chamber 126 for reciprocal axial movement between the stop pieces 120 and 122 and it is responsive to a magnetic field to exert a biasing action on the pin 132 in the direction of the spool 114. A casing 136 surrounds the circumference of the armature assembly 118 and includes an electrical coil 138 and an associated yoke 140 arranged to induce a magnetic field having lines of flux 142 through the plunger 134 when current is passed through the coil 138.

The yoke 140 has its one end 144 essentially in engagement with the front stop piece 120, and it has its rear end 146 essentially in engagement with the rear stop piece 122 so that minimal air gap exists between either end piece and the yoke 140. Thus, the only significant air gap that exists in the lines of flux 142 is the working gap 148 that exists between the plunger 134 and the stop pieces. To accomplish this feature, the tube 124 has an axial length sufficiently small so that the front and rear stop pieces 120 and 122 are connected thereto between the locations where engagement of the front and rear stop pieces 120 and 122 with the yoke 140 occurs. Thus, the air gap that exists in the prior art units between the yoke and either of the stop pieces has been eliminated.

By virtue of the improved construction of the present invention, the tube 124 can now be manufactured throughout its length of stainless steel material which has non-magnetic properties and the thickness of the wall can be sufficiently great so that the tube 124 can be threadedly connected to the front stop piece 120 and the rear stop piece 122, as shown at 150 in FIG. 4. As thereshown, the tube 124 is internally threaded, and the stop piece 122 is externally threaded.

To further improve the construction to permit maximum numbers of lines of flux to pass through the plunger 134, it is preferred that the rear end piece 122 be constructed in a cup-shape with the open end thereof facing the front stop piece 126. The plunger 134 is slidably movable in an axial direction in the interior of the rear stop piece 122 and has an enlarged head portion 152 for seating on the lip 154 of the cup-shaped stop piece 122 when the plunger 134 is in its rearward position in engagement with the stop piece 122. The plunger 134 is slotted, as at 156, to allow free flow of the hydraulic fluid past the plunger during its axial movements.

The enlarged head portion of plunger 134 provides a further benefit in that by virtue of this arrangement the flux path area of the head portion can expand so that the flux path area of the plunger matches or is essentially the same as the flux path area of the front stop piece 120. Thus, a suitable number of slots 156 may be provided in plunger 134 to minimize hysteresis losses therein without reducing the flux path area of the plunger 134 below that of the flux path area of front stop piece 120. In this respect, it is to be understood that the effective cross-sectional area of the flux path of the yoke 140, of the areas of engagement at 144 and 146, of the rear stop piece 122 and of the plunger 134 is essentially the same as and at least equal to that of the front stop piece 120 to achieve even flux density.

Also, in the conventional manner, a manual override push pin 158 adjacent to the plunger 134 is provided.

It is claimed:

1. A wet plunger solenoid for actuating a hydraulic valve comprising an armature assembly including front and rear magnetic stop pieces, a non-magnetic tube connected at opposite ends respectively to said front and rear magnetic stop pieces and defining therebetween a chamber, said front stop piece having a duct extending axially therethrough in communication with said chamber and for communication with hydraulic fluid within said valve, a pin positioned in said duct for axial movement and extending exteriorly of said front stop piece, and a plunger mounted within said chamber for reciprocal axial movement between said stop pieces and responsive to a magnetic field to exert a biasing action on said pin, and a casing surrounding the circumference of the armature assembly and including a coil and an associated yoke arranged to induce a magnetic flield through said plunger when current is passed through the coil, said yoke having its opposite ends in engagement respectively with the front and rear stop pieces so that the working gap between the plunger and the stop pieces is the only air gap in the induced magnetic field, said tube having an axial length sufficiently small so that said front and rear stop pieces are connected thereto between the locations where engagement of the front and rear stop pieces with said yoke occurs thereby to eliminate an air gap between the yoke and either stop piece, said rear stop piece being cup-shaped with the open end thereof facing said front stop piece and defining a lip, said lip having a step around the outer circumference thereof into which the end of said tube is fitted so that a seating portion extends radially inwardly to the radially inner wall of the cup-shaped stop piece, said plunger being slidably movable in an axial direction in said rear stop piece in engagement with said radially inner wall and having an enlarged head portion for seating on the seating portion defined by the lip when the plunger is moved to its engaged position with the stop piece, the outer wall of said cup-shaped stop piece being in engagement with one end of said yoke, and said enlarged head portion being sufficiently large to expand the flux path area to be at least as great as the flux path area of the front pole piece.

2. The wet plunger solenoid that is defined in claim 1, wherein said tube is stainless steel and is connected at opposite ends to said stop pieces at locations where the ends of the tube are fitted into the steps of the lips.

3. The wet plunger solenoid that is defined in claim 1, wherein said tube is internally threaded at its opposite ends, and said stop pieces are externally threaded at their steps and are threadedly connected thereby to the internally threaded ends of said tube, said threads being arranged so that the ends of the tubes engage the bottoms of the steps.

4. The wet plunger solenoid that is defined in claim 1, wherein the effective cross-sectional area of the flux path of the yoke, of said opposite ends of the yoke that engage the front and rear stop pieces, of the rear stop piece, and of the plunger is at least equal to the effective cross-sectional area of the flux path of the front pole piece.

* * * * *